United States Patent [19]

Shavyrin et al.

[11] 3,968,043

[45] July 6, 1976

[54] METHOD OF PREPARATION OF MATERIAL FOR LUBRICATION OF EXTERNAL SURFACE OF DRILLING PIPE

[76] Inventors: Vladimir Sergeevich Shavyrin, Ploschad Svobody, 4, kv. 18; Vyacheslav Nikolaevich Gusakov, ul. Kuibysheva, 23, kv. 3, both of Gorky; Klavdia Vasilievna Pankova, ul. Tsiolkovskogo la, kv. 50, Volgograd; Nina Petrovna Polyakova, Ploschad Svobody, 4, kv. 116; Natalya Petrovna Shirkaeva, ul. Svetloyarskaya, 75, kv. 5, both of Gorky; Valentin Nikolaevich Gorin, ul. Basseinaya, 53, kv. 1; Oleg Semenovich Goyovin, ul. Mikhailova, 8, kv. 29, both of Leningrad, all of U.S.S.R.; Alexei Egorovich Mastjukova, deceased, late of Gorky, U.S.S.R.; by Maria Pavlovna Mastjukova, heir at law, Ploschad Svobody, 4, kv. 67, Gorky, U.S.S.R.

[22] Filed: May 13, 1975

[21] Appl. No.: 576,959

Related U.S. Application Data

[63] Continuation of Ser. No. 472,866, May 23, 1974, abandoned, which is a continuation-in-part of Ser. No. 268,894, July 3, 1972, abandoned.

[52] U.S. Cl. ..... 252/56 R; 106/230; 106/232; 106/234; 252/8.5 M; 252/9; 252/16; 252/59

[51] Int. Cl.[2] ..... C10M 1/24

[58] Field of Search ..... 252/8.5 M, 9, 16, 43, 252/56 R, 59; 106/230, 232, 234; 117/135

[56] References Cited

OTHER PUBLICATIONS

Kirk–Othmer, "Encyclopedia of Chemical Technology," vol. 11 (1953) pp. 781–782.

Boner, "Manufacture and Application of Lubricating Greases" (1954) pp. 146–147, 795–799.

*Primary Examiner*—Delbert E. Gantz
*Assistant Examiner*—Andrew H. Metz
*Attorney, Agent, or Firm*—Holman & Stern

[57] ABSTRACT

A method of preparation of a lubricant for lubricating the external surface of a drilling pipe comprising the steps of preparing a mixture consisting essentially of gear-box oil, petroleum paraffins, bitumen and tall oil pitch; primary heating of said mixture to 100°C and secondary heating up to 300°C.

1 Claim, No Drawings

METHOD OF PREPARATION OF MATERIAL FOR LUBRICATION OF EXTERNAL SURFACE OF DRILLING PIPE

This is a continuation of application Ser. No. 472,866 filed May 23, 1974 which in turn is a Continuation-in-Part of Ser. No. 268,894 filed July 3, 1972, both cases now abandoned.

The present invention relates to methods of preparing materials for lubrication or the external surface of drilling pipes used in the process of drilling wells preferably with diamond or hard alloy drilling crowns with water being used as mud fluid.

It is known that a drilling pipe rotating at a high speed is subject to heavy vibration, which is transmitted both to the drilling crown and rig. This causes their rapid wear, reduction of the drilling speed and higher consumption of diamonds and hard alloys. The vibration leads to considerable increase (sometimes by a factor of 2 to 2.5) in power consumption during rotation of the drilling pipes in the well.

Hence, the drilling tool vibration control is one of the basic and most important problems in the modern diamond drilling practice, the solution of which would make it possible to rotate the diamond crown at a speed from 500 up to 1500 rpm.

The use of the most effective and inexpensive means for vibration control which are materials for lubrication of drilling pipes, opens the way for wide application of diamond drilling as well as for increasing its efficiency.

Known in the art is a method of preparing a material comprising rosin, gear-box oil and bitumen for lubrication of the external surface of a drilling pipe. The mixture is heated to 100°C and kept at this temperature for 20 minutes. Then the material is considered for use as a lubricant.

According to this method the components of the mixture are heated to a melting point for making a homogeneous material. At this temperature the components of the mixture do not enter into chemical reactions. The material obtained allowed to decrease to some extent the vibration of drilling pipes in the process of drilling.

However, the material did not have adequate resistance against mud fluid and was easily washed off from the surface of drilling pipes.

For this reason, it was required to apply the material several times. This in turn led to considerable consumption of materials, and additional labor and time in performing the above-mentioned operation.

In addition, preparation of the material requires the use of rosin as one of the components (rosin content may be as high as 25–30% by weight). It increases the cost of the product and reduces the efficiency of its application. Rosin is one of the most important products of naval stores industry and finds wide application in production of adhesives, esters, varnishes, lubricating oils, insulation materials and various coatings.

Attempts have been made to replace rosin with some other more readily obtainable materials. However such materials could not provide required adhesion of the lubricating material with the surface of drilling pipes, washed by mud fluid.

When dealing with a wide scope of drilling work, an increase of productivity of drilling tools is required. However, an increase of rotation speed of the drilling pipes leads to vibration of the pipes and to the friction between the pipes and well walls, and makes drilling impossible at high speed.

The basic object of the invention is to provide a method of preparing a material for lubrication of the external surface of a drilling pipe which material will sufficiently reduce vibration of the drilling pipes at the increased speed of the drilling process.

A specific object of the invention is to increase the drilling speed and to increase the life of the drilling tool, while reducing the consumption of diamonds leading in turn to increasing productivity of the drilling tools and more effective drilling process.

Another object of the invention is to provide a material resistant to the washing off action of the mud fluid.

Still another object of the invention is the replacement of an expensive and relatively scarce component, used in the lubricant known in the art, by a cheap and more easily obtainable material.

These and other objects of the invention are obtained by means of a method of preparation of a lubricant for lubricating the external surface of drilling pipes comprising the steps of preparing a mixture consisting essentially of 55–75% by weight of gear-box or transmission lubricating oil, 5–35% by weight of tall oil pitch, 5–10% by weight of petroleum paraffins and, optionally, bitumen; heating said mixture to 100°C; holding said mixture at this temperature for 20 minutes while stirring; heating the mixture to 300°C; and holding the mixture at this temperature for one hour.

The components mentioned have the following characteristics:

Gear-box or transmission lubricating oil - a petroleum rectification product with a congealing temperature of not higher than −20°C as the highest; mechanical impurities not exceeding 0.05% by weight; a relative viscosity at 100°C of 2.7–3.2°(18.7–22 centistokes); containing traces of water and not containing water soluble acids and alkali; and having a flash point (in the open cup) of not below 170°C. The gear box oil is the main component of the proposed lubricant. The gear-box oil imparts a desirable consistency to the lubricant and reduces its solubility in water.

Bitumen- an oxidation product of petroleum distillation residue, petroleum cracking process and petroleum products. It is a solid material with a melting point not below 90°C; solubility in chloroform and benzene not less then 99% by weight; the depth of needle penetration at 25°C is in the range 5–20 mm, expansibility at 25°C is not less than 1 cm; weight loss at 160°C after 5 hours is not more than 1%; the depth of needle penetration into residue (after testing for weight loss from initial weight) is not less than 60%; flash point is not below 230°C; water soluble acids and alkali are not present; water is present in not more than trace amounts water soluble compounds are present in not more then 0.3% by weight.

The bitumen is introduced into the lubricant to make it viscous. Amounts of bitumen greater than 5% by weight in the lubricant makes the lubricant fragile and this leads to sliding of the lubricant from the drilling pipe surface.

Petroleum paraffins are solid crystalline products, recovered from a distillate raw material. These paraffins have a melting point not below 50°C; odorless; oil content is not higher then 2.3% by weight; they do not contain mechanical impurities and water soluble acids and alkali.

Petroleum paraffins increase water repelling capacity of the lubricant.

Tall oil pitch is a tall oil rectification product; both soft and hard tall oil pitch may be used for preparing the lubricant proposed by the authors.

Tall oil pitch increases the adhesion of the lubricant to a metal surface.

The hard tall oil pitch has the following characteristics:

acid number, mg KOH/g 30–35; saponification number, mg KOH/g 80–100; melting point-not below 75°C; unsaponifiables - 30–35% by weight.

The soft tall oil pitch has the following characteristics:

acid number, mg KOH/g 45; saponification number mg KOH/g 127; melting point is not higher than 75°C as the highest; both hard and soft tall oil pitches must not contain water soluble sodium and potassium salts, free alkali and soda.

The proportion of the above-mentioned components found by the authors makes it possible to prepare a material with acceptable resistance to the washing-off action from the surface of the pipes, and thus may be effectively used in the process of drilling.

The replacement of relatively scarce and expensive rosin by tall oil pitch makes it possible to reduce the price of proposed material without deterioration of its qualities such as washing-off resistance in water and adhesion to metal surfaces. The material spread on the surface of a drilling pipe is transferred in the process of drilling to the cracks in the walls of the well. This results in a reduction in the friction force of the drilling pipe against the walls of the well and a reduction in leakage of the mud fluid through the cracks in the walls.

In accordance with the proposed method the mixture is heated in two steps. At the first step compounds are melted and effectively stirred during the period of time it is held.

At the second step of heating the mixture the components enter into chemical reaction and its desirable characteristics are stabilized during the period it is held.

The invention will be better understood from the consideration of the examples of the proposed method of preparing a material for lubrication of the external surface of a drilling pipe.

EXAMPLE 1

The reactor is loaded with gear-box oil 55% by weight of, 35% by weight of soft tall oil pitch, 5% by weight of petroleum paraffins and the mixture is heated to 100°C and carefully stirred during 15 minutes. Then the reaction mixture undergoes the second step of heating, when it is heated to 260°C and is held at this temperature for one hour. The ready lubricant, cooled to 90°C is poured into a metal container.

EXAMPLE 2

The reactor is loaded with 65% by weight of gear-box oil, 25% by weight of soft tall oil pitch 5% by weight of petroleum paraffins and 5% by weight of bitumen. At the first step the mixture is heated to 100°C and is held at this temperature for 15 minutes with careful stirring.

At the second step the mixture is heated to 270°C and is held at this temperature for one hour. The ready material cooled to 90°C is poured into a metal container.

EXAMPLE 3

The reactor is loaded with 72% by weight of gear-box oil, 8% by weight of petroleum paraffins and 20% by weight of and hard tall oil pitch. The mixture is heated to 100°C and is carefully stirred at this temperature for 20 minutes. Then the reaction mixture undergoes the second step of heating, when it is heated to 300°C and is held at this temperature for an hour. The ready lubricant cooled to 90°C is poured into a metal container.

EXAMPLE 4

The reactor is loaded with 75% by weight of gear-box oil, 10% by weight of petroleum paraffins 10, and hard tall oil pitch 15% by weight. The mixture is heated to 100°C and is carefully stirred during 20 minutes at this temperature. Then the reaction mixture undergoes the second step of heating when it is heated to 280°C and is held at this temperature for one hour. The ready lubricant cooled to 90°C is poured into a metal container.

The lubricant for lubricating the external surface of a drilling pipe prepared in accordance with the proposed method is an odorless homogeneous product with a density at 50°C, 0.945–0.970 g/cm$^2$; at 80°C the density is 0.925–0.950 g/cm$^2$; viscosity at 80°C is not higher than 440 seconds; protective value (against corrosion) on the steel plate at 20°C is 48 hours; and not washed off in water.

Tests have shown that the material prepared in accordance with the above-mentioned method, decreases considerably the vibration of the drilling pipe; such decrease has resulted in reduction of diamond consumption to 25–30% and increase of drilling speed to 30–45%, stabilization of the rig's work and increase in its working life.

The material prepared according to the proposed method reduces the force of friction of the drilling pipe against the walls of the wall, thus reducing the input power required for the operation of the machine by 30–50%.

The wear of the drilling pipes is reduced while drilling speed of the tool is increased and, therefore, the material helps to increase the efficiency of the rig, while drilling deep wells.

It was found that the material prepared according to the proposed method protects drilling pipes against corrosion and substantially prevents absorbtion of mud fluid by the cracks in walls or wells.

We claim:

1. A method of preparing a lubricant for lubrication of the external surface of a drilling pipe comprising the following steps: preparing a mixture consisting essentially of 55–75% by weight of transmission lubricating oil obtained as a petroleum rectification product, with a congealing temperature of not higher than − 20°C; a relative viscosity at 100°C of from 18.7 to 22 centistokes and an open cup flash point of at least 170°C, 5–10% by weight of petroleum paraffins with a melting point of at least 50°C, 15–35% by weight of tall oil pitch and, optionally, bitumen obtained as a result of oxidation of petroleum distillation residues with a melting point of at least 90°C, a solubility in chloroform and benzene of at least 99 percent by weight and a flash point of at least 230°C; primary heating said mixture to 100°C with subsequent holding of said mixture at this temperature for 20 minutes while stirring to obtain a homogeneous mass; and secondary heating said mixture to 300°C with subsequent holding of the mixture at this temperature for one hour to obtain the final lubricant product.

* * * * *